United States Patent [19]

Young

[11] Patent Number: 4,545,527

[45] Date of Patent: Oct. 8, 1985

[54] RAILROAD GRADE CROSSING

[76] Inventor: Thomas B. Young, 8745 Riggs Cir., Overland Park, Kans. 66212

[21] Appl. No.: 472,014

[22] Filed: Mar. 4, 1983

Related U.S. Application Data

[63] Continuation-in-part of Ser. No. 366,836, Apr. 9, 1982, abandoned.

[51] Int. Cl.[4] ..... E01B 7/28; E01B 2/00; E01C 9/04

[52] U.S. Cl. ..... 238/8; 238/6

[58] Field of Search ..... 238/1–9

[56] References Cited

U.S. PATENT DOCUMENTS

| | | | |
|---|---|---|---|
| 2,089,025 | 8/1937 | Hedgcock | 238/8 |
| 2,833,480 | 5/1958 | Sandberg | 238/8 |
| 3,465,963 | 9/1969 | Caillet et al. | 238/8 |
| 3,517,882 | 6/1970 | Hooper | 238/8 |
| 3,643,864 | 2/1972 | Ziegler | 238/8 |
| 3,894,686 | 7/1975 | Weinberg et al. | 238/8 |
| 3,955,761 | 5/1976 | Szarka et al. | 238/8 |
| 4,093,120 | 6/1978 | Canfield | 238/8 |
| 4,117,977 | 10/1978 | Whitlock | 238/8 |
| 4,147,304 | 4/1979 | Blyton | 238/8 |
| 4,253,605 | 3/1981 | Sims | 238/8 |
| 4,267,969 | 5/1981 | Hales et al. | 238/8 |
| 4,445,640 | 5/1984 | Caillet | 238/8 |

FOREIGN PATENT DOCUMENTS

| | | | |
|---|---|---|---|
| 61429 | 9/1982 | European Pat. Off. | 238/8 |
| 132074 | 8/1978 | German Democratic Rep. | 238/8 |

*Primary Examiner*—Robert B. Reeves
*Assistant Examiner*—David F. Hubbuch
*Attorney, Agent, or Firm*—Schmidt, Johnson, Hovey & Williams

[57] ABSTRACT

A railroad grade crossing is provided with elastomeric decking pads presenting an upper, vehicular crossway substantially coplanar with the tops of the metallic rails, in turn, secured to the spaced cross ties therebeneath which rest on the roadbed of the roadway. Deck-supporting grillage structure, supported by the cross ties includes a series of spaced cross beams of metallic material arranged to preclude the transmission of electrical currents across the rails. The grill is also provided with spaced, non-metallic, longitudinal beams between the I-shaped cross beams and the deck. The longitudinal beams, to which the deck is attached, rest on the cross ties and are tied to the cross beams. Because of the unique suspension principle which the crossing employs, no drilling of holes in the cross ties is required, nor is any type of fastening to the cross ties required.

9 Claims, 3 Drawing Figures

RAILROAD GRADE CROSSING

This is a continuation-in-part of my copending application Ser. No. 366,836, filed Apr. 9, 1982, now abandoned.

Virtually all types of railroad grade crossings have many inherent disadvantages. Installation costs are relatively high, they are not long lasting and seemingly, they are in a constant state of disrepair. Maintenance and replacement is not inexpensive; therefore, bumpy conditions for vehicular cross traffic present an exasperating problem in need of solution.

In accordance with the concepts of my present invention, there is presented a novel crossing which is relatively inexpensive yet long lasting. It is essentially unaffected by conditions which normally cause the need for repair or replacement and will, therefore, remain smooth and solid for a long period of time. Installation, repair and replacement can be attended to quickly, easily, and at relatively low cost.

It is supported by the cross ties which underlie the rails and includes a series of spaced, longitudinal beams which rest directly on the cross ties. Suspended from the longitudinal beams and extending thereacross is a series of spaced, metallic I beams clamped in placed by a number of spaced U bolts which hold one end of each I beam against the lower face of one of the rails.

However, the alternately arranged I beams do not bridge the distance across the rails, thereby avoiding the transmission of electrical currents between the rails. To this end also, elastomeric deck pads overlying the non-metallic longitudinal beams are attached to the latter by easily accessible fasteners.

Figure 1:
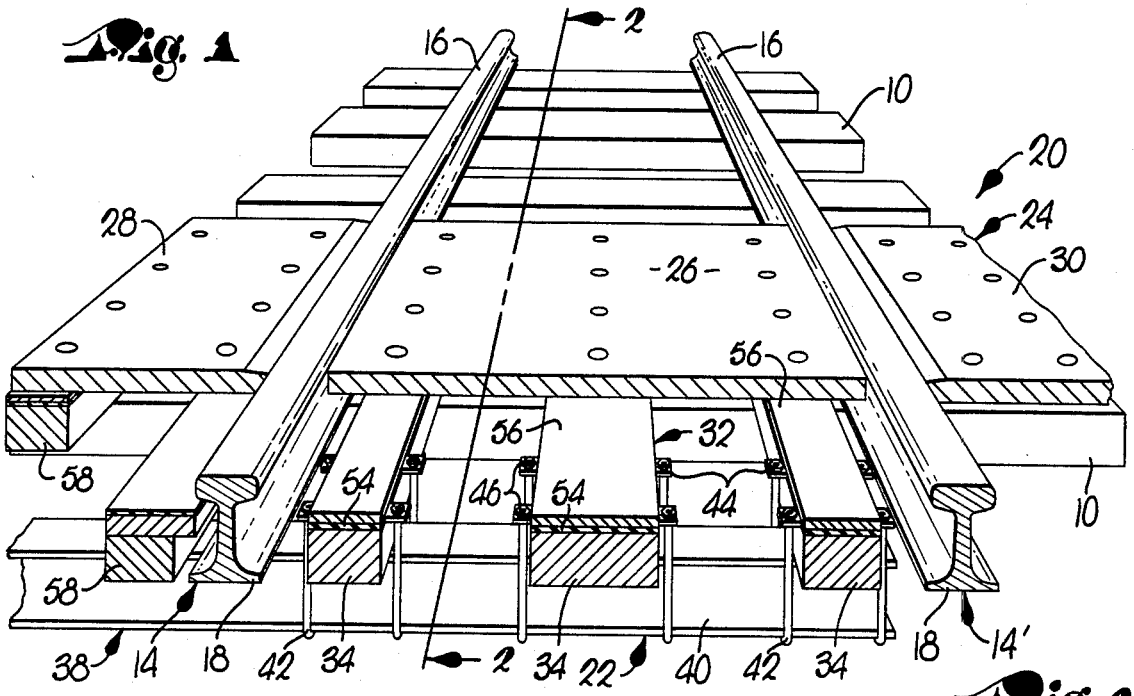
FIG. 1 is a fragmentary top perspective view of a railroad grade crossing made pursuant to my present invention.
Figure 2:
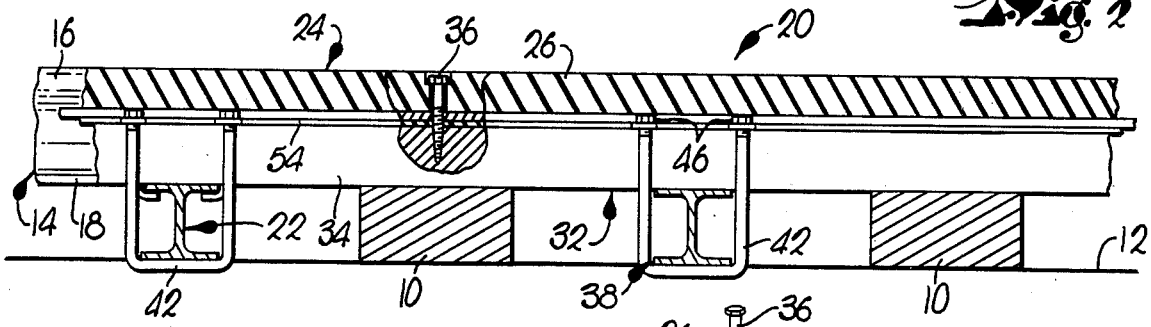
FIG. 2 is a fragmentary cross sectional view taken along line 2—2 of FIG. 1.

In the drawing, a roadway is shown provided with a series of elongated, spaced apart cross ties 10 resting on a roadbed 12 and supporting a pair of spaced, parallel rails 14 and 14' for the rolling stock of an operating railroad. The rails 14, 14' may be of standard lengths or appreciably longer as is commonplace at highway-railway grade crossings. Or, as is also well known, the rails 14, 14' may be made continuous by welding their lengths together in end-to-end relationship. The rails 14, 14' are normally supported by tie plates (not shown) on the cross ties 10, and spikes are usually driven into the cross ties 10 through the tie plates to hold the rails 14, 14' in place. Each rail 14, 14' as shown, has an upper wheel-supporting and guiding track 16 and a pair of opposed, lower, laterally-projecting, longitudinally-extending flanges 18.

In accordance with the principles of my present invention, an improved grade crossing 20 is provided with grillage structure 22 in the nature of a framework of cross beams disposed above the roadbed 12, together with decking 24 taking the form of elastomeric padding overlying and supported by the structure 22. The decking 24 includes an intermediate or center pad 26 between and spaced from the rails 14, 14' and a pair of side pads 28 and 30 extending upwardly beyond the corresponding rail 14, 14'. By virtue of the construction of my novel crossing 20, the upper vehicular crossway of the decking 24 is maintained coplanar with the tops of the tracks 16.

The structure 22 includes an upper set 32 of spaced, elongated, longitudinal beams 34 between the rails 14, 14' and interposed between the pad 26 and the cross ties 10 in engagement with both, but spaced from the rails 14, 14'. A number of fasteners 36 (such as lag screws) attach the decking 24 to the non-metallic beams 34. The structure 22 also includes a lower set 38 of parallel, spaced apart, elongated, transverse cross beams 40 on the roadbed 12. It is contemplated that the cross beams 40 be transversely I shaped and made from metallic material.

The three beams or timbers 34 between the rails 14, 14', resting on the cross ties 10, are each clamped to each I beam 40 by a number of spaced U-bolts 42 looped beneath the I beams 40, and each bolt 42 is provided with a plate 44 which extends across the corresponding timber 34. Each bolt 42 has a pair of upper nuts 46 tightly engaging its corresponding plate 44.

The I beams 40 do not span the distance between the rails 14, 14'; instead, the bolts 42 hold the I beams 40 clamped against the lower face of but one of the rails 14 or 14' while the opposite ends of the I beams 40 remain spaced from the opposite rail 14 or 14'. For example, viewing FIG. 3, the I beam **40*a* is shown spaced from the rail 14 but underlying the rail 14'. On the other hand, the next succeeding I beam 40*b* is shown spaced from the rail 14' but underlying the rail 14. Such alternate arrangement of the I beams 40 continues throughout the length of the crossing 20 with at least one I beam 40 being provided between each pair of cross ties 10**.

Figure 3:
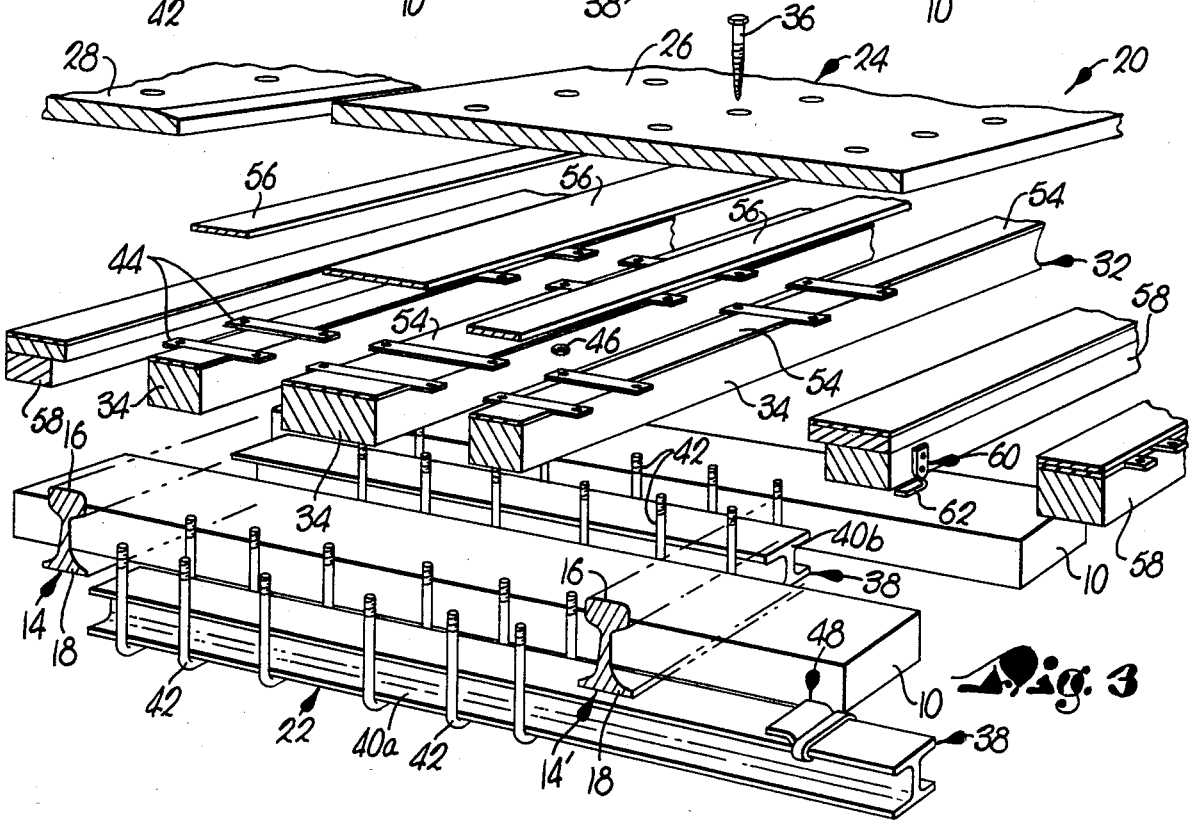
FIG. 3 is a perspective exploded view of the crossing illustrated in FIGS. 1 and 2.

In FIG. 3 also, there is illustrated a metal clip 48 for connecting the rail 14' to the I beam **40*a*. The clip 48 has a lip 50 which is placed in overlying engagement with the outer flange 18 of the rail 14'. The clip 48 is also provided with claws 52 which are looped over the upper flanges of the I beam 40*a*. Manifestly, though not shown, the next I beam 40*b* will be provided with a clip 48 for connecting it with the overlying rail 14**.

The third I beam 40 (not shown) will, therefore, have a clip 48 connected with its upper flange but, in this case the clip 48 will overlap the inner flange 18 of the rail 14'. Once again such alternate arrangement of the clips 48 along the rails 14, 14' will continue throughout the length of the crossing 20. Each timber 34 is covered by abrasion pads 54, except at the plates 44, and the pads 54 are, in turn, covered by shims 56 which preclude undue pressure of the center pad 26 against the nuts 46 as a result of the weight of traffic on the pad 26. The fasteners 36 pass through the shims 56 and the abrasion pads 54 into the timbers 34, with their heads disposed below the top of the center pad 26.

Support for the side pads 28 and 30 by the cross ties 10 is essentially the same as the support for the center pad 26. Depending upon the widths of the side pads 28 and 30, each has two or more beams 58 engaging certain of the I beams 40 and constructed much the same as the beams 34. They are held in place by twisted brackets 60 spiked thereto and having extensions 62 which overlie proximal beams 40. The may be disposed alternately on the inside and on the outside of each beam 58 along the lengths of the latter and, of course, fasteners 36 are employed as in the case of the center pad 26.

For the most part, all components of my crossing 20 are readily obtainable on the open market at no substantial cost. Installation is neither time consuming, complicated nor expensive. The cross beams 40 can be laid in place on the roadbed 12 each extending beneath one of the rails 14 or 14' as above described and the longitudinal beams 34 and 58 then laid in place on the cross ties 10 and on the beams 40.

The bolts 42 and their plates 44 may then be properly placed and clamped down by the easily accessible nuts 46 following which the clips 48 and the bracket 60 are applied without interference by any other structure. The pads 54 and the shims 56 are laid in place and the decking 24 is attached by use of the fasteners 36 to complete the task. Equally important is the ease of repair and replacement and the fact that no currents of electricity can flow between the rails 14 and 14'.

I claim:

1. In combination with a roadway having a roadbed, a series of elongated, spaced apart, non-metallic cross ties resting on said roadbed and a pair of elongated, spaced apart, metallic rails overlying and supported by said cross ties, each rail having an upper, wheel-supporting and guiding track, and a pair of opposed, lower, laterally-projecting, longitudinal flanges, a railroad grade crossing comprising:

grillage structure supported by said cross ties; and decking supported by said structure;

said decking having an upper, vehicular crossway substantially coplanar with the tops of said tracks, said structure including a plurality of elongated, spaced apart, metallic cross beams spanning substantially the entire distance between the rails and disposed to preclude transmission of electrical currents across the rails, certain of the cross beams being in underlying engagement with one of the rails and spaced from the other of said rails;

the remaining cross beams being in underlying engagement with said other rail and spaced from said one rail, said certain cross beams alternating with said remaining cross beams.

2. The invention of claim 1, each cross beam having a fastener at one end thereof connecting the same with the rail engaged thereby.

3. The invention of claim 2, each cross beam having a pair of opposed, upper, laterally-projecting, longitudinal flanges, said fasteners connecting the flanges of the rails with the flanges of the cross beams.

4. In combination with a roadway having a roadbed, a series of elongated, spaced apart, non-metallic cross ties resting on said roadbed and a pair of elongated, spaced apart, metallic rails overlying and supported by said cross ties, each rail having an upper, wheel-supporting and guiding track, and a pair of opposed, lower, laterally-projecting, longitudinal flanges, a railroad grade crossing comprising:

grillage structure supported by said cross ties; and decking supported by said structure;

said decking having an upper, vehicular crossway substantially coplanar with the tops of said tracks, said structure including a plurality of elongated, spaced apart, metallic cross beams disposed to preclude transmission of electrical currents across the rails, said structure including a number of spaced apart, longitudinal beams, spaced from the rails, resting on the cross ties between the rails and interposed between the cross beams and the decking; and means interconnecting the longitudinal beams and the cross beams, said interconnecting means including a plurality of fasteners spaced along each cross beam respectively and looped therebeneath.

5. The invention of claim 4, each longitudinal beam having a shim underlying the decking for limiting the extent of movement of the latter toward the fasteners.

6. The invention of claim 5, and abrasion pads interposed between the shims and the longitudinal beams.

7. In combination with a roadway having a roadbed, a series of elongated, spaced apart, non-metallic cross ties resting on said roadbed and a pair of elongated, spaced apart, metallic rails overlying and supported by said cross ties, each rail having an upper, wheel-supporting and guiding track, and a pair of opposed, lower, laterally-projecting, longitudinal flanges, a railroad grade crossing comprising:

grillage structure supported by said cross ties; and decking supported by said structure;

said decking having an upper, vehicular crossway substantially coplanar with the tops of said tracks, said structure including a plurality of elongated, spaced apart, metallic cross beams disposed to preclude transmission of electrical currents across the rails, said structure including a number of spaced apart, longitudinal beams, spaced from the rails, resting on the cross ties between the rails and interposed between the cross beams and the decking; and means interconnecting the longitudinal beams and the cross beams, said decking including an elastomeric, center pad extending along said longitudinal beams between the rails and releasably anchored to the longitudinal beams.

8. The invention of claim 7, said decking including a pair of elastomeric side pads extending along said rails, there being at least one, outermost, longitudinal beam disposed beneath each side pad respectively and resting on the cross ties; and means releasably anchoring the side pads to their corresponding outermost beams.

9. The invention of claim 8, and means attaching the outermost beams to the cross ties.

* * * * *